US006789285B1

(12) United States Patent
Haapamäki

(10) Patent No.: US 6,789,285 B1
(45) Date of Patent: Sep. 14, 2004

(54) PULP WASHING METHOD AND PLANT

(75) Inventor: Pertti Haapamäki, Montreal (CA)

(73) Assignee: Metso Paper Pori Oy (FI)

( * ) Notice: Subject to any disclaimer, the term of this patent is extended or adjusted under 35 U.S.C. 154(b) by 115 days.

(21) Appl. No.: 10/031,473

(22) PCT Filed: Jul. 10, 2000

(86) PCT No.: PCT/FI00/00634

§ 371 (c)(1),
(2), (4) Date: Jan. 17, 2002

(87) PCT Pub. No.: WO01/09432

PCT Pub. Date: Feb. 8, 2001

(30) Foreign Application Priority Data

Jul. 21, 1999 (FI) ..... 991631

(51) Int. Cl.[7] ..... D06B 3/02
(52) U.S. Cl. ..... 8/156; 68/175; 68/181 R; 68/184
(58) Field of Search ..... 8/156; 68/147, 68/175, 181 R, 184, 200

(56) References Cited

U.S. PATENT DOCUMENTS 2,089,992 A * 8/1937 Campbell et al.
3,298,900 A * 1/1967 Laakso
3,652,384 A * 3/1972 Sloman
3,807,202 A * 4/1974 Gunkel
3,843,473 A * 10/1974 Samuelson et al.
3,881,985 A * 5/1975 Simmons et al.
4,162,215 A * 7/1979 Klotz
4,705,600 A 11/1987 Jacobsen
4,732,651 A * 3/1988 Lisnayansky et al.
4,874,468 A * 10/1989 Sbaschnigg et al.
5,116,423 A 5/1992 Kokkonen et al.
5,482,594 A 1/1996 Salminen
5,551,574 A * 9/1996 Hicks et al.
5,567,262 A 10/1996 Phillips et al.
5,741,399 A * 4/1998 Antkowiak
6,071,380 A * 6/2000 Hoffman
6,461,473 B1 * 10/2002 Qvintus et al.

FOREIGN PATENT DOCUMENTS

WO 96/17966 A1 6/1996
WO 96/10379 A1 3/1997

* cited by examiner

*Primary Examiner*—Frankie L. Stinson
(74) *Attorney, Agent, or Firm*—Lerner, David, Littenberg, Krumholz & Mentlik, LLP

(57) ABSTRACT

A method of improving the efficiency of the multistage washing of pulp, wherein the initial washing of a given batch of pulp is carried out using a gradually diluted, recovered filtrate fraction originating from the washing of the preceding batch of pulp as the washing liquid, prior to the final washing of the pulp batch. In the method, the recovered fraction filtrate is kept stored in such a way that the concentration gradient of dissolved substances is maintained until the fraction is used for washing the following batch of pulp. A further object of the invention is a pulp washing plant, wherein the method according to the invention is carried out in a laboratory-scale test washer and applied to industrial pulp washing plant solutions.

7 Claims, 3 Drawing Sheets

PULP WASHING METHOD AND PLANT

FIELD OF THE INVENTION

This invention relates to the field of pulp washing technology. Objects of the invention are a method of washing pulp by means of a gradually diluted wash filtrate recovered at an earlier stage of the washing, and a plant for carrying out the method.

BACKGROUND ART

The washing of pulp—the removal of dissolved, undesired components from the pulp following various delignification stages—is still one of the most difficult operations even in the field of the most recent pulping technology, calling for continuous development of equipment and improvement of methods within the washing processes throughout the fibre line.

There are many kinds of washers in use, drum and Fourdrinier wire washers, presses and diffusers operating at various pressures.

The continuous aim being, for both economical and environmental reasons, to reduce the amount of water consumed per pulp ton, multistage washing methods and plants have been developed wherein the wash filtrate is re-circulated through the pulp at a process stage at which the pulp is less pure than the relevant filtrate. For example, in Finnish patent application 980481, a method of re-circulating washer filtrates is described, which method can be applied to a multistage drum washer. The pulp web to be washed is divided into zones from which the filtrate fractions are individually collected and returned in the counter-flow direction to serve as washing liquids in less pure zones. Multistage washing methods have been developed also for diffusers, as described in U.S. Pat. No. 4,705,600. A multistage wash is particularly difficult to carry out in pressure diffusers, as it is hard to avoid channelling in the pulp and intermixing of the filtrate fractions collected. In U.S. Pat. No. 5,567,262, a two-stage pressure diffuser is disclosed in which the filter unit is divided into two compartments and in which the wash filtrate of the less pure end is returned counter-currently. Further, U.S. Pat. No. 5,482,594 discloses a pulp washer operating at elevated pressure and having two main stages, in which the batch of pulp slurry is first dewatered on a wire table and subsequently carried to a washing position on the table. The recirculation of wash filtrates is also described, wherein filtrate fractions having different concentrations are collected in individual containers and wherein the number of washing stages can be five or more, depending on the number of collecting vessels and on the recirculation order.

DISCLOSURE OF THE INVENTION

BRIEF DESCRIPTION

The method according to claim 1 has now been invented for improving the efficiency of multistage washing, wherein the initial washing of a given batch of pulp is performed by means of a steplessly diluted, recovered filtrate fraction originating from the preceding batch of pulp, prior to the final washing of the pulp batch using available washing water or filtrate coming from the process. In the method, the recovered fraction filtrate is kept stored in such a way, that the concentration gradient of the dissolved substances is maintained until the fraction is used for washing the following batch of pulp, which is not possible in the conventional intermediate fraction tanks in any type of prior art multistage wash A further object of the invention is a pulp washing plant wherein the method according to the invention is carried out in a laboratory-scale test washer and applied to industrial pulp washing plant solutions.

DETAILED DESCRIPTION

Figure 1:
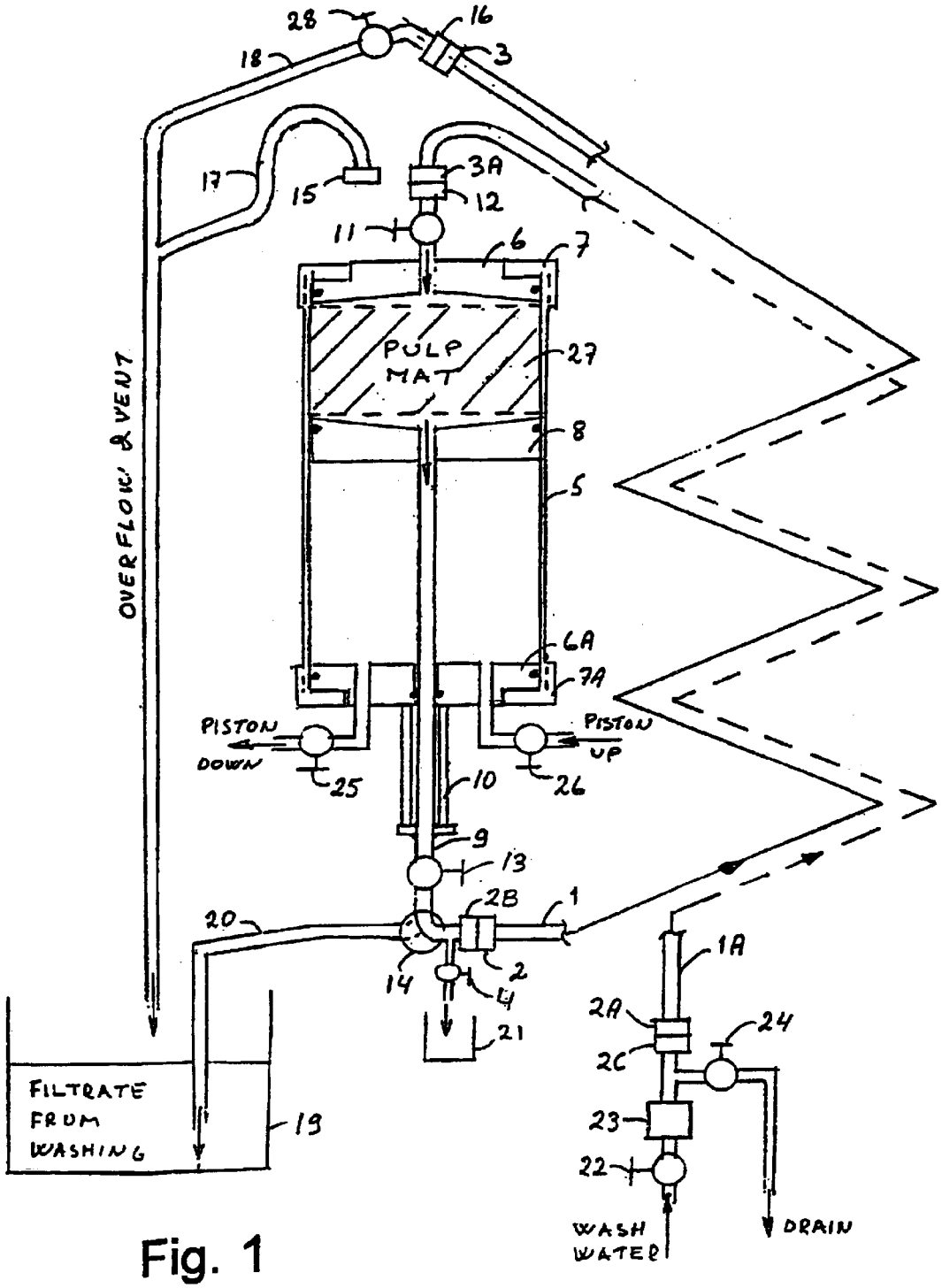
FIG. 1 shows a laboratory-scale test plant according to the invention.

The basic functional principle of the invention will be explained in more detail in the following, with reference to the accompanying drawing, wherein FIG. 1 shows the principle of a testing plant according to the invention. The main parts of the plant are a pulp washing cylinder 5, filtrate holding pipes 1 and 1A and a collecting tank 19 for the leaving filtrate liquor and a control unit 23 for the washing water.

A batch of pulp 27 to be washed is formed in the cylinder 5 as follows: the threaded fastening ring 7 of the cylinder is unscrewed and the washing water distributor head 6 comprising a screen is removed from the top of the cylinder. Valve 13 is closed and three-way valve 14 is opened to wash filtrate outlet pipe 20. A desired amount of pulp is poured into the cylinder 5, simultaneously lowering the piston 8 by opening and closing a valve 25 located on the hydraulic water discharge side of the cylinder. The distributor head 6 is put back in place and valve 11 is opened. The coupling 15 of overflow pipe 17 is fitted to coupling 12 of the washing water distributor head. A stopper 10 for limiting piston movement is placed on a circular plate fixed to piston rod 9, below the cylinder. The height of the stopper determines the upper position of the piston, which ensures that a pulp mat 27 of a constant thickness is always formed between the screen faces. The free air is removed from the cylinder, from above the pulp, by opening and closing a valve 26 located on the hydraulic water feeding side and, consequently, by raising the pulp surface by means of piston 8 to lie against the screen face of the distributor bead 6 and further, until filtrate starts to flow into overflow pipe 17. The valve 11 is closed and the overflow coupling 15 is removed from coupling 12 of the distributor head. Valve 13 is opened. Raising the piston is continued by opening valve 26, until piston movement limiting stopper 10 engages. Valves 26 and 13 are closed. A pulp mat 27 has been formed and the mother liquor of the pulp mat formation has been transferred to filtrate liquor collecting tank 19.

It is assumed, that at this stage holding pipe 1A is filled with fraction filtrate obtained from the washing of the preceding batch of pulp. Holding pipe 1A is connected to washing water coupling 2C by means of a coupling 2A at its lower end, and to coupling 12 of the washing water distributor head by means of a coupling 3A at its upper end. All the couplings used in the test plant are hydraulic quick couplings comprising locking spindles. In order to maintain the concentration gradient of the filtrate fraction led from the bottom of the pulp mat 27 during the short period of storage, the filtrate holding pipe 1A is made of thin, pressure-proof and preferably transparent pipe having an inside diameter of 10 to 15 mm, the inside diameter of cylinder 5 being 100 to 150 mm. The pipe is mounted on a supporting structure having an outside diameter of 150 to 250 mm as a spiral of such length that it can hold an amount of fraction filtrate at least 1 to 2 two times larger relative to the basic amount of liquor in the pulp cake. This results in a washing efficiency 2 to 4 times greater compared with a normal single stage wash. The filtrate to be displaced has the highest concentration of dissolved substances at the beginning of the wash, after which the concentration of the solution gradually declines as washing proceeds. Thus, the filtrate portion having the lowest concentration lies in the bottom part of holding pipe 1A, in front of the washing water coupling 2A, and the filtrate amount having the highest concentration has moved, during the filling of the holding pipe, to the upper end thereof, closer to the pulp mat 27 to be washed. The fraction filtrate holding vessel 1, which is identical to 1A as far as dimensions and fittings are concerned, is empty and connected to a filtrate liquor inlet coupling 2B by means of a coupling 2 at its lower end and is in ventilating connection with the overflow pipe 18 via couplings 3 and 16 and an open valve 28.

The washing of the pulp mat is performed as follows: Valves 11 and 13 and the washing water control valve 22 are opened, and the unit 23 for controlling the amount of washing water is started. If the aim is to perform the washing in a pressurised state and, consequently, to affect the behaviour of the air in the system, the control unit 23 is allowed to control valve 13 instead of valve 22. However, valve 13 is not opened and washing is not started until the desired pressure has been reached in the washing chamber of the pulp mat 27 with the aid of the pressurised washing water. Starting to move, the washing water pushes the fraction filtrate stored in holding pipe 1A ahead of it, through the pulp mat 27, with the result that the most concentrated fraction filtrate thereof displaces the most concentrated mother liquor from the mat directly into the wash filtrate tank 19 through pipe 20. The control unit 23 estimates how much filtrate is discharged into the wash filtrate tank and indicates when the desired volume is reached. At this stage, three-way valve 14 is immediately turned into its second position, so that the wash filtrate required in the continuous fraction wash is directed into fraction holding pipe 1, beginning to fill it. After the fraction wash filtrate has run out, the washing of the pulp mat continues uninterrupted using the regular washing water available, until unit 23 for controlling the amount of washing water sends an impulse to close washing water valve 22. Valve 22 is closed immediately, as well as valves 11 and 13. The shifting of wash filtrate flow destination from wash filtrate collecting tank 19 to fraction pipe 1 using three-way valve 14 is timed in the control unit in such a way, that the smallest possible amount of fraction filtrate (the most concentrated filtrate, however) is carried directly into collecting tank 19 through overflow pipe 18. If the washing is performed in a pressurised state, it is possible to increase the pressure in fraction vessel 1 by choking ventilation valve 28, preventing the hot filtrates from swelling in the fraction vessel. Couplings 2 and 3 of holding pipe 1, which is full of washing water, are unconnected. Coupling 3A is disconnected from coupling 12 of the distributor head and it is connected to coupling 16 of ventilation pipe 18. Valve 24 is opened and the washing water is allowed to drain from holding pipe 1A. The piston movement limiting stopper 10 is removed, the fastening ring 7 is unscrewed and the washing water distributor head 6 and the pulp mat 27 are pushed out of the cylinder with piston 8. Drain valve 4 is opened and the filtrate stored in the pipe system is emptied into container 21. The filtrate is recovered and the amounts of chemicals therein are taken into account when calculating the washing factors. The three-way valve 14 is turned toward pipe 20. The coupling 2A of tubular vessel 1A, which is drained of washing water, is disconnected from washing water coupling 2C and shifted to coupling 2B. The unconnected coupling 2 of the lower end of holding pipe 1 and coupling 3 of the upper end thereof are connected to washing water coupling 2C and to coupling 12 of the washing water distributor head, respectively.

A new batch of pulp can now be washed in the testing plant. The operations are the same as described above except for the filtrate holding pipes 1 and 1A that always have reversed functions after each washing of a new batch of pulp.

When studying fractional washing by means of the test washer, it was observed that to reach an acceptable equilibrium for the liquor concentrations in the fraction filtrate pipe, the washing operation described above must be performed 5 to 8 times in succession using the same amounts of pulp and washing water, the testing conditions being as identical as possible.

Figure 2:
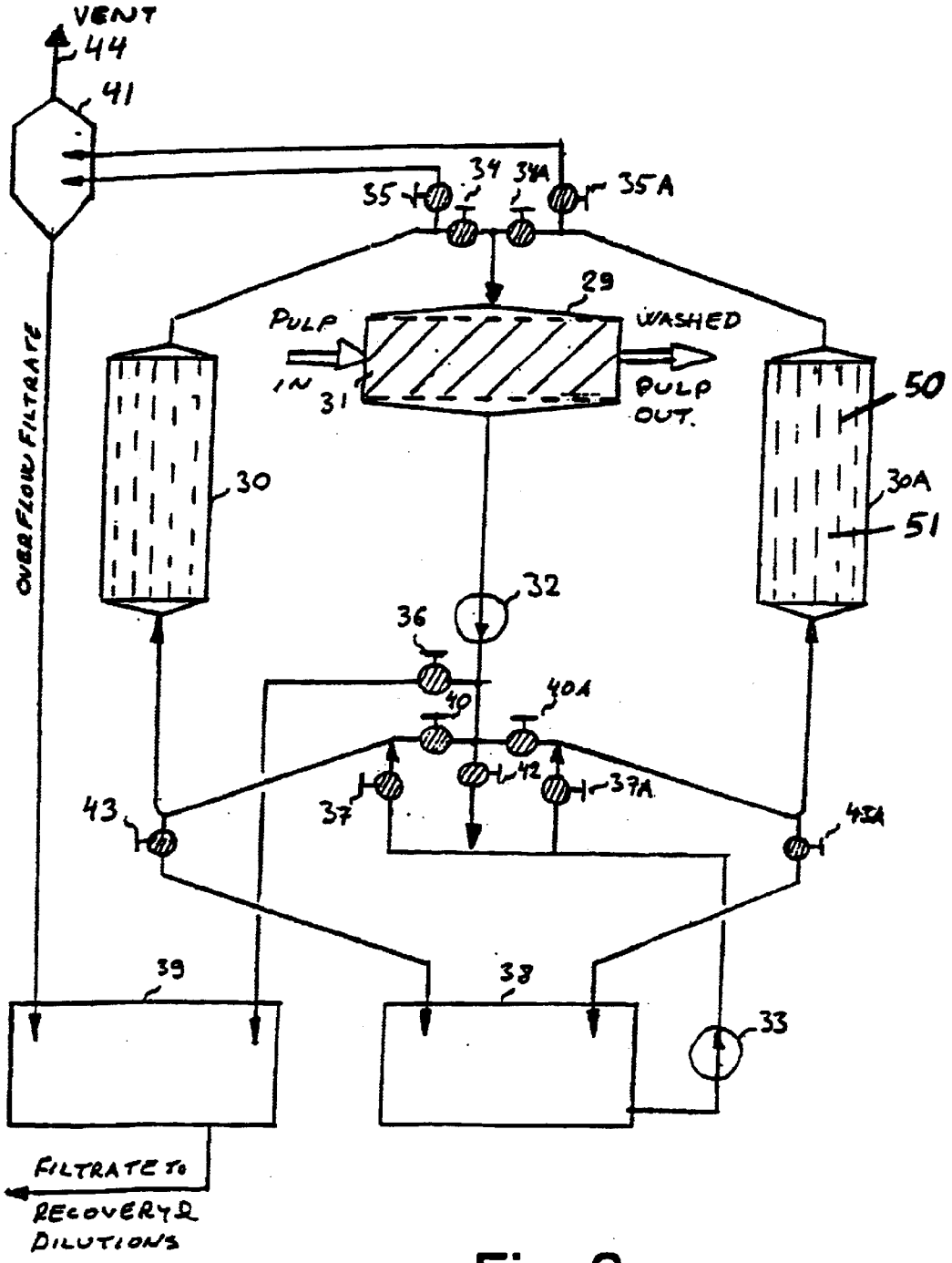
FIG. 2 is a schematic view of an industry-scale washing plant according to the invention.

FIG. 2 shows the principle of an industry-scale plant according to the invention. The main parts of the plant are pulp washer 29, filtrate tanks 30 and 30A corresponding to the holding pipes 1 and 1A of the testing plant described above, and tanks for the leaving filtrate liquor 39 and for the washing water 38.

When the operation is started, tank 30A is full of filtrate obtained from the washing of a pulp batch of a given size. In order to maintain the concentration gradient of the filtrate fraction pumped out of the bottom of the pulp batch 31, tank 30A is of a cellular design; thus, vertical partition walls 50 divide the tank into a plurality of narrow cells 51 extending in the direction in which the flow passes through the tank, preferably providing a honeycomb-shaped cross section. The filtrate first displaced from the batch of pulp to be washed has the highest concentration of dissolved substances. This spreads over the whole width of the tank bottom, from where the filtrate rises into all empty cells. Any small differences in flow rate that may occur at the beginning of the filling disappear immediately due to gravity, and as the liquid level rises, the filtrate fractionates in the tank, in the same way over the whole width all the way to the top end. Thus, when tank 30A is full, the least concentrated part will lie in the lowest part thereof, above the inlet connection, and the most concentrated part of the filtrate in the upper part, below the outlet connection. The filling of the tank from below upward enhances the separation of air from the filtrate, and it can be removed from above the liquid surface of the tank in the filtrate overflow stage at the latest. When the operation cycle starts, tank 30 is empty. A new batch of pulp 31 to be washed has been formed in washer 29. All valves are closed.

Washing of the pulp 31 is started by a pre-wash. The pumps 32 and 33 start. The valves 34A, 35, 36 and 37A open to their set values. Washing water flows from the tank 38 into the lower part of the tank 30A, pushing the filtrate fraction in the tank ahead of it The distribution of the displacement liquid evenly over the whole cross-sectional area of the tank having a large diameter can be ensured using a separate washing water inlet pipe system and choke nozzles, which are not shown in FIG. 2. The filtrate leaving via the upper end of the fraction tank and having the highest concentration of dissolved substances penetrates into the pulp layer 31, displacing most of the mother liquor into a filtrate liquor tank 39 through a valve 36. When a predefined amount, for example 1.2 times the liquid volume of the pulp layer, has been displaced, valve 36 closes. Valve 40 opens and the after-washing stage begins.

The pumping of washing water from tank 38 into tank 30A continues. The filtrate leaving the pulp is stored in tank 30, which is identical to tank 30A When tank 30 becomes fill, the flow can continue, for a given time, as overflow into an air separation and overflow cyclone 41 through valve 35 and further into filtrate liquor tank 39. Once the washing is completed, the valves 37A, 34A, 35 and 40 close and the pumps 32 and 33 stop. The ventilation valve 35A and the drain valve 43A open, with the result that the unused washing water flows from tank 30A back into the washing water tank 38. Valve 43A closes. The washed pulp layer 31 leaves the washer 29. Valve 42 opens and the last, purest filtrate fraction is led back into the washing water pipe system, to the front of the pump 33 to be used as washing water, as the first litres of the flow in the following wash. Valve 42 closes.

Figure 3:
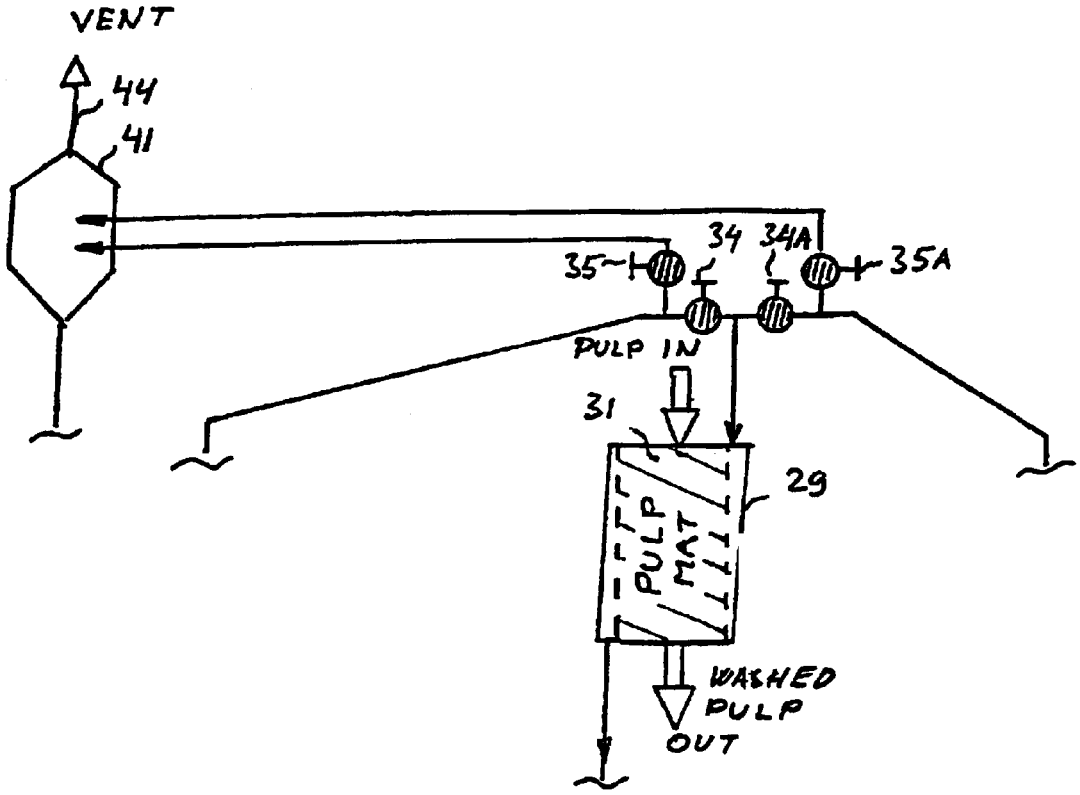
FIG. 3 is a partial view of the upper part of FIG. 2 and shows another embodiment of the washing plant according to FIG. 2, in which the treatment of the batch of pulp to be washed is carried out in an alternative manner.

A new layer of pulp 31 is forming in the washing chamber of the washer 29 and a new washing cycle can begin. The operation is identical to the washing operation described above except for the fact that the function of tanks 30 and 30A and their corresponding valves have been reversed. In FIG. 2, the washer 29 is shown as an apparatus in which the pulp layer moves in the horizontal plane, as in a Fourdrinier wire washer. The apparatus described in U.S. Pat. No. 5,482,594 mentioned above is an example of such a device. In this case, the washing chamber may have a screen face only at the bottom. The invention can also be applied to batch-type twin wire precipitation devices. Furthermore, a plant using the technique according to the invention can be provided with a vertical pulp path by applying, for example, the technology described in U.S. Pat. No. 5,567,262. FIG. 3 is a schematic view of the upper part of such a plant; in other respects and as far as reference numbers are concerned, the figure is identical to the upper part of FIG. 2. The method can, for example, be applied to a continuous process by using prior art methods according to the diffuser principle, in which case the periodically operating fractional washing is completed during the time while the assembly composed of the washing water distributor screen and the pulp mat washing screen ran parallel along the main pulp flow in the diffuser.

A new unwashed batch of pulp is generated between the washing water distributor screen and the washing screen when the screen package is jolted back to its initial position.

The production capacity of the plant according to the invention can be estimated as follows:

$$P = \frac{v * et * A * D * 8,64}{S * 100 - c_{in}/c_{in} + (100 - c_{out})/c_{out} + DF}$$

wherein

P=production capacity, ODT/24h v=speed of the wash filtrate, cm/s determined using the testing plant according to FIG. 1, for example et=effective washing time of a single washing cycle as a percentage A=filtration area available for the wash, $m^2$ D=density of the washing liquid, $t/m^3$ S=number of mother liquor displacements at the fractional wash stage $c_m$=pulp consistency in the mat, %

$c_{out}$=consistency of the leaving, washed pulp, %

DF=dilution factor of the wash, t/ODT

If the values are v=0,7, et=80, D=1, S=1,5, $c_m$=$c_{out}$=10 and DF=2,5, for example, a 24-hour production capacity of approximately 19,4 ODT per square meter is achieved.

What is claimed is:

1. A method for washing pulp comprising the steps of:

(a) displacing a first volume of liquid from a batch of pulp with a first volume of washing liquid;

(b) displacing said washing liquid as a wash filtrate from said pulp with a second volume of washing liquid, and at least partly recovering said wash filtrate into a holding vessel while maintaining a concentration gradient within said wash filtrate in said holding vessel;

(c) replacing said pulp with an unwashed batch of pulp; and (d) displacing liquid from said unwashed batch of pulp according to step (a) wherein said washing liquid comprises said wash filtrate with said concentration gradient recovered in step (b).

2. A method according to claim 1 further comprising the step of repeating steps (b) through (d).

3. A method according to claim 1 including displacing said wash filtrate with said concentration gradient from said holding vessel with washing water, and returning said washing water remaining in said holding vessel to a washing water tank for use in the displacement of subsequent filtrates.

4. A pulp washing plant comprising a pulp washing chamber, means for delivering pulp into said pulp washing chamber and for removing said pulp from said pulp washing chamber, and at least two vessels having inlet and outlet connections for receiving and holding a wash filtrate, said at least two vessels being adapted to maintain a concentration gradient of said wash filtrate between said inlet and outlet connections, and means for delivering said wash filtrate from said at least two vessels into said pulp washing chamber.

5. The plant of claim 4 wherein said at least two vessels comprise a pipe or a hose.

6. The plant of claim 4 wherein said at least two vessels include an inside structure comprising parallel channels extending in a flow through direction of said at least two vessels.

7. The plant as in claim 4 wherein said at least two vessels include a top and a bottom, whereby said at least two vessels can be filled from said bottom and provided with ventilation and overflow from said top.

* * * * *

UNITED STATES PATENT AND TRADEMARK OFFICE

CERTIFICATE OF CORRECTION

PATENT NO. : 6,789,285 B1
DATED : September 14, 2004
INVENTOR(S) : Pertti Haapamaki It is certified that error appears in the above-identified patent and that said Letters Patent is hereby corrected as shown below:

Column 2,
Line 2, insert a period -- . -- after "wash".

Column 5,
Line 8, begin a new paragraph at "Once".
Line 22, begin a new paragraph at "In".
Line 50, both instances of "$C_{in}$" should read -- $C_m$ --.

Signed and Sealed this

Eighteenth Day of January, 2005

JON W. DUDAS
*Director of the United States Patent and Trademark Office*